US008267269B2

(12) United States Patent
Gundersen

(10) Patent No.: US 8,267,269 B2
(45) Date of Patent: Sep. 18, 2012

(54) COLLAPSIBLE FOOD GUARD, DISPLAY AND SERVER

(76) Inventor: Craig Gundersen, Dundee, IL (US)

( * ) Notice: Subject to any disclaimer, the term of this patent is extended or adjusted under 35 U.S.C. 154(b) by 0 days.

(21) Appl. No.: 12/587,611

(22) Filed: Oct. 9, 2009

(65) Prior Publication Data

US 2011/0084071 A1 Apr. 14, 2011

(51) Int. Cl.
*B65D 8/14* (2006.01)
*B65D 41/56* (2006.01)

(52) U.S. Cl. ..... 220/7; 220/212; 220/252; 220/377; 220/810

(58) Field of Classification Search ..... 206/461, 206/464, 470, 774; 219/385, 725, 734; 220/4.28, 220/4.33, 6, 7, 62, 212, 252, 377, 291, 297, 220/810, 833, 834; 403/282, 345, 361, 375; 426/113, 115

See application file for complete search history.

(56) References Cited

U.S. PATENT DOCUMENTS 2,550,998 A * 5/1951 Hilliker ..... 220/252
D259,690 S 6/1981 Buchsteiner nee Fetzer
4,422,441 A 12/1983 Schoepe
4,585,915 A 4/1986 Moore
5,037,000 A * 8/1991 Selame ..... 206/470
5,111,956 A 5/1992 Jow
5,305,875 A * 4/1994 Meyer ..... 220/4.28
5,377,856 A * 1/1995 Brierton ..... 220/4.33
5,542,560 A 8/1996 Gerster
5,564,568 A * 10/1996 Rankin, Sr. ..... 206/446
6,164,477 A * 12/2000 Druckman et al. ..... 220/7
6,189,722 B1 2/2001 Ason
7,243,809 B2 7/2007 Bezar
7,326,895 B1 2/2008 Henderson

OTHER PUBLICATIONS

U.S. Appl. No. 12/128,196, filed May 28, 2008, Gundersen.

* cited by examiner

*Primary Examiner* — Luan K Bui
(74) *Attorney, Agent, or Firm* — McDonnell Boehnen Hulbert & Berghoff LLP

(57) ABSTRACT

The present invention is directed to a collapsible food guard for displaying and serving food comprising a resilient transparent cover assembly for a substantially planar base. The cover assembly is substantially semi-cylindrical of a predetermined radius and has closed opposing ends. The cover assembly is reversibly pivotably attached to a base and has downward facing edges to seal the cover to the base when the cover is pivoted in the down (closed) position. The semi-cylindrical portion of the cover assembly is a resilient transparent shield that reversibly detachable from the arched surfaces of the closed opposing ends (side walls) and is sufficiently resilient such that when detached form the arched surfaces of the opposing side walls, it assumes the substantially planar shape in which it was initially molded. This resiliency allows the collapsible food guard to collapse into planar elements (side walls, shield and optional base) requiring minimal storage space and providing easy cleaning.

18 Claims, 14 Drawing Sheets

COLLAPSIBLE FOOD GUARD, DISPLAY AND SERVER

FIELD OF THE INVENTION

The present invention is in the field of food service and display. More particularly, the present invention is a device for displaying foods under a clear protective canopy that allows for easy viewing, protection against insects and wind burn and provides for easy cleaning. Because the device of the present invention is collapsible to a flattened or substantially planar form, it is storable in a minimal space. The present invention is useful because it provides a reusable, readily storable, and readily cleanable device for protecting foods from environmental factors and preserving freshness in an outdoor or indoor setting.

BACKGROUND OF THE INVENTION

Serving food outdoors is a great American tradition. However, containers of open food are often an invitation to annoying insects which light upon the food and render it unappetizing to unsanitary. Also, the wind can dry out many foods, particularly breads and cakes, rendering them hard or unappetizing. At picnics, tables are decked with covered food containers which are suddenly uncovered to allow guests access to the food within a short window. Typically, the covers are solid (e.g., foil) or opaque plastic or heavy glass. The former two do not allow sight of the food until removed. The latter cover, while allowing sight of the food, is heavy, often the size of the serving container, and must be moved to a location other than the serving table for lack of room to set it down while accessing the food. Otherwise, one needs a cooperative guest to hold the cover while one accesses the food underneath. When the covers are removed, it is often a battle between the guests and the insects as to who gets the food. This causes the foods to be recovered and one has to peak under the many covers to rediscover that dish from which one seeks seconds. At large commercially catered events, the problem becomes even more exaggerated. It is an object of the present invention to provide a device that displays food under a clear sanitary cover, that allows one to single handedly tilt the cover to gain access to the food, and to retilt the cover down to reprotect the food while offering visual access and decision making to the next guest. In this way, all the guests do not have to eat as soon as the food is opened and can access food and desserts at their palates desire.

A second problem at such gatherings is cleaning and storing all of the food containers. Food covers for plates and desserts add another dimension to the storage needs of the homeowner. On a commercial scale, the storage needs for such covers, which largely occupy open space, becomes immense. Accordingly, it is another object of the present invention to provide a food guard that is readily collapsible to a substantially planar (space saving) shape during non-use. This planar shape also facilitates cleaning, particularly in a mechanical washer. A further object is that the space saving (substantially planar) shape must readily reassemble into its curved (space encompassing) shape when needed for duty. A further object is that assembly must be simple and not require tools to affect completion.

U.S. Pat. No. 5,542,560, entitled "Protective and Warming Bonnet for Food," issued to Gerster, et al., on Aug. 6, 1996. The '560 patent teaches a collapsible food cover that is a "folding bellows . . . made of pleated paper, in the manner of a Chinese lanterns." U.S. Pat. No. 4,422,441, entitled "Disposable Stackable Splatter shield and Frame Thereof," issued to Schoeppe on Dec. 27, 1983, discloses a collapsible splatter shield that is a pleated metal foil. However, neither of these devices has any permanency, neither is cleanable, and neither allows one to visualize what is underneath when in an operative position.

Des. Pat. 259,690, entitled "Dish with Hinged Cover," issued to Buchsteiner nee Fetzer on Jun. 30, 1981. The '690 patent discloses a non-collapsible fixed shape dish with a transparent hinged cover. While the '690 patent allows one to see the food under the cover, the device is an assembled unit that is not collapsible and thus occupies substantial space when stored en mass. Thus, there is an unsolved need for a space saving device that allows one to visualize and access food on a congested table, and that after use is readily collapsible to facilitate storage in a minimal amount of space.

SUMMARY OF THE INVENTION

The present invention is directed to a collapsible food cover, display and server (hereinafter "collapsible food guard") having multiple embodiments. In one embodiment, the present invention is directed to a collapsible food guard for displaying and serving food comprising a resilient transparent cover assembly for covering a substantially planar base. The cover assembly is substantially semi-cylindrical in shape, having a predetermined radius and having closed opposing ends (side walls). The cover assembly is reversibly pivotably attached to the base by way of a hinge member. The cover assembly also has downward facing edges to seal the cover to the base when the cover is pivoted in the down (closed) position. When the cover assembly is pivoted in the upward (open) position, the cover assembly exposes the base and any contents thereon. The cover assembly has a hinge member for slideably engaging and disengaging from the planar base, such as after use. The semi-cylindrical portion of the cover assembly is a resilient transparent shield that reversibly detachable from the arched surface of the closed opposing ends and is sufficiently resilient such that when detached form the arched surfaces of the opposing ends, it assumes the substantially planar shape in which it was initially molded. This resiliency allows the food cover to collapse into planar elements (side walls, resilient shield and optional base) requiring minimal storage space.

It is within the scope of the above described embodiment that the collapsible food guard have a resilient transparent cover that is a clear resilient plastic such as but not limited to polycarbonate, polyethylene terephthalate or polyvinyl chloride, more preferably, a polycarbonate. It is also within the scope of the above described embodiment that the substantially planar base is wood, plastic (e.g., melamine), glass, ceramic, stone, or a stone composite. Such bases are discussed in more detail herein. A preferred base is wood, plastic, or ceramic, preferably a wooden cutting board, a service tray, a service platter or a perimeter frame for the base. The perimeter frame (which looks like a wooden picture frame) acts as a base and support for the shield assembly and allows the user to place her favorite platter under the shield assembly. It is also within the scope of this embodiment that the cover is reversibly pivotably attached to the base by a male hinge member that slideably inserts into a hinge slot on the upper planar surface of the base, such as shown in FIG. 1 or FIG. 3. Preferably, the hinge slot has a circular cross-section comprising from 182° of arc to 350° of arc, more preferably, from 188° of arc to about 245° of arc. It is also within the scope of the present invention that the hinge be a live hinge. When the hinge is a live hinge, the hinge slot may have any cross sectional shape because the correspondingly shaped male hinge member does not need to rotate in the hinge slot. However, the live hinge may also be used in combination with a hinge slot that has a substantially circular cross-section In another embodiment, the present invention is directed to a collapsible food guard for displaying and serving food comprising a stationary base member and a pivotable shield assembly; the stationary base member comprising a substantially planar upper surface having a linear hinge slot therein sized and shaped for slideably receiving a male hinge member, the pivotable shield assembly being semi-cylindrical in shape and having opposing closed ends, the pivotal shield assembly comprising a resilient transparent shield, a first opposing sidewall and a second opposing sidewall, the resilient transparent shield being substantially rectangular in shape having a frontal edge, a distal edge and two opposing lateral edges, the distal edge being attached to a male hinge member that is sized and shaped for slideably entering the linear hinge slot on the stationary base member to form a pivotable hinge, each of the opposing sidewalls having an arcuate upper surface for reversibly engaging a respective opposing lateral edge of the resilient transparent shield and having a planar lower surface for pivotably engaging the planar surface of the base member, the opposing lateral edges of the resilient transparent shield having substantially the same length as the arcuate upper surface such that when the resilient transparent shield is bent to engage and conform to the arcuate surface, the opposing side walls and shield forming a pivotable semi-cylindrical dome having planar base, the planar base forming a seal with the planar upper surface of the stationary base member when the pivotable shield assembly pivots downward, thereby displaying any item thereunder, the shield assembly providing access to any contents under the shield assembly when the shield assembly pivots upward.

In yet another embodiment, a resilient transparent shield assembly comprising a resilient transparent shield and opposing side walls having slideable hinge assemblies 70 and 80 is a stand alone invention in itself. This latter invention is usable with the consumer's existing base member, albeit a cutting board, a tray or a platter, and does not require a proprietary base member as part of the invention.

BRIEF DESCRIPTION OF SEVERAL VIEWS OF THE DRAWINGS

FIG. 2 also displays one type of hinge that is suitable for opening and closing the resilient transparent shield 5.

DETAILED DESCRIPTION OF THE INVENTION

Figure 1:
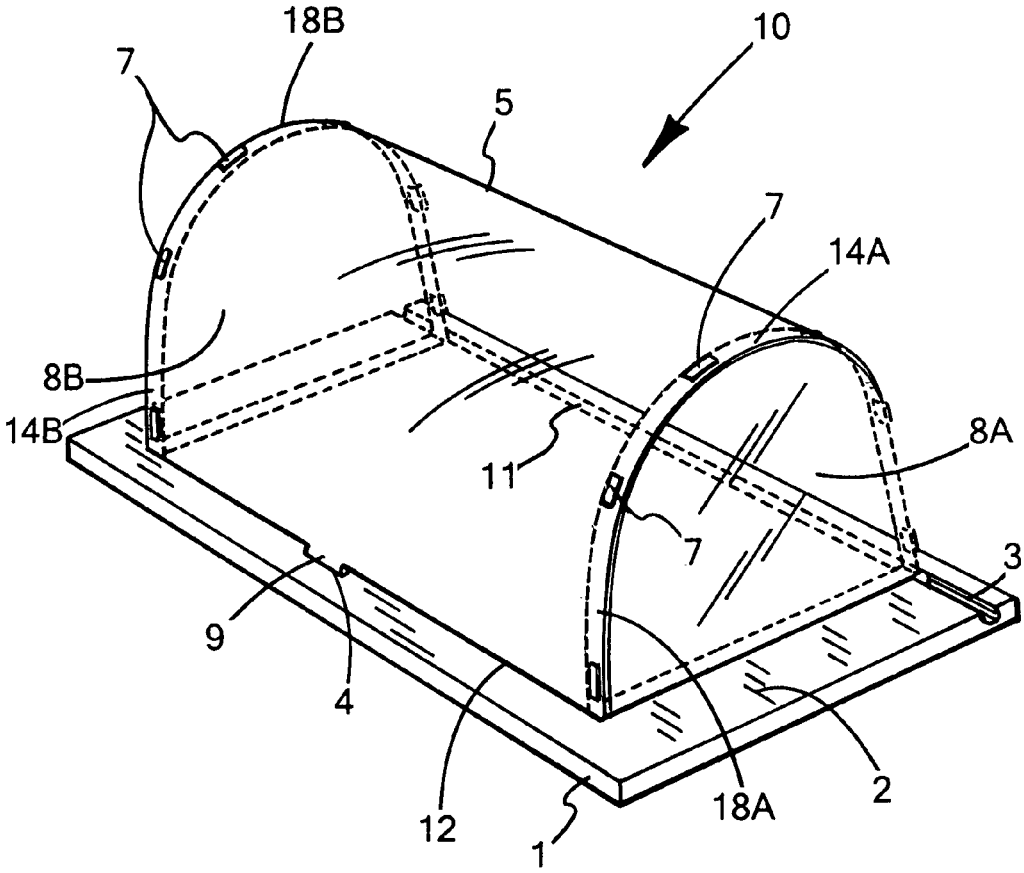
FIG. 1 is a perspective view of one embodiment of the collapsible food guard of the present invention in the assembled and closed (display) position having an optional notch 4 and latch 9 combination for retaining the resilient transparent shield 5 in the closed position.

The collapsible food guard of the present invention has multiple embodiments. FIG. 1 discloses a collapsible food guard 10 of the present invention in the assembled and closed (display) position and comprises a stationary base member 1, and a pivotable shield assembly thereover comprising a resilient transparent shield 5 and two opposing walls 8A and 8B. The base member is has a substantially planar upper surface 2 and is made from any material suitable for presenting, serving, cutting or storing food. Suitable materials for the base member 1 are materials that are machinable or moldable to a flat surface, and include wood (e.g., plank, or a laminate cutting board), plastics (e.g., melamine), stone (e.g., marble, granite, onyx), glass, a composite (e.g., CORIAN®), a ceramic or laminates (e.g., FORMICA®). (e.g., a cutting board), glass, plastic, or stone (such as granite or marble). When plastic is used, the plastic is food grade, nonporous for easy cleaning and may be transparent, translucent or opaque and optionally colored. It is also within the scope of the present invention that the base member be in the form of a tray or platter. The resilient transparent shield 5 is typically made from a substantially rectangular sheet of clear resilient plastic that can be bent repeatedly to form a gently curved surface (see 5 in FIG. 1) by applying minimal hand pressure and that will return to a flat surface (see 5 in FIG. 6) when the applied pressure is removed. The resilient transparent film must be thick enough to be resilient when bent as in FIG. 1 yet not so thick as to crack upon repeated bending. Preferred plastics for the resilient transparent shield 5 are polycarbonate, polyvinyl chloride (PVC) or polyethylene terephthalate (PET). All these plastics are commercially available. A more preferred plastic is polycarbonate. Suitable polycarbonates are sold under the trademarks LEXAN® or LUCITE®. Suitable thicknesses for the resilient transparent shield range from 0.0156 to 0.0626 inches. The collapsible food guard 10 has two opposing side walls 8A and 8B that have matching arched (arcuate) surfaces 18A and 18B, respectively. In FIG. 1, the resilient transparent shield 5 is bent to engage arched surfaces 18A and 18B and conform to their length and curvature. To retain the resilient transparent shield 5 in its curved conformation, the opposing lateral edges 14A and 14B of resilient transparent shield 5 each have 1-4 mortises (slots) 6 for receiving corresponding tenons 7 projecting from each of arched surfaces 18A and 18B of corresponding side walls 8A and 8B, respectively. Preferably, there are 2-3 mortise and tenon joints along each arched surface. More preferably, there are 3 mortise and tenon joints along each arched surface 18A and 18B, such as the three shown in FIG. 1. Because the lateral edges 14A and 14B of the resilient transparent shield are substantially the same length as the length of arched surfaces 18A and 18B, when the resilient transparent shield is fixed to the arched surfaces 18A and 18B, the bottom of sidewalls 8A and 8B, the frontal edge 12 of shield 5 and the distal edge 11 of shield 5 form a plane that is suited for seating upon the planar upper surface 2 of the stationary base member 1. The opposing side walls 8A and 8B of food guard 10 are made of any material described herein, including wood, stone, glass or plastic. In one embodiment, the opposing side walls 8A and 8B are made of the same material as the stationary base member 1. In another more preferred embodiment, the opposing side walls 8A and 8B are made of the same material as the resilient transparent shield 5. Thus, depending upon their construction material, the opposing side walls are transparent, translucent or opaque. Optionally, the opposing side walls 8A and 8B are vented by incorporating an opposing screen (not shown) on or into each of the side walls. The opposing screens allow condensation to dissipate when hot food is stored under the shield assembly and prevent the resilient transparent shield 5 from losing its transparency due to condensation building up on the shield's 5 inside surface. The opposing side walls are support walls and thus are generally thicker than the resilient transparent shield. The side walls have a thickness that ranges from ⅛ inch to ¾ inches depending upon the material selected. When the walls are thin, they are optionally flared along their peripheral edges to a "T" shape to give the walls greater strength against bending and a wider arched surface for supporting and engaging the resilient transparent shield.

Figure 2:
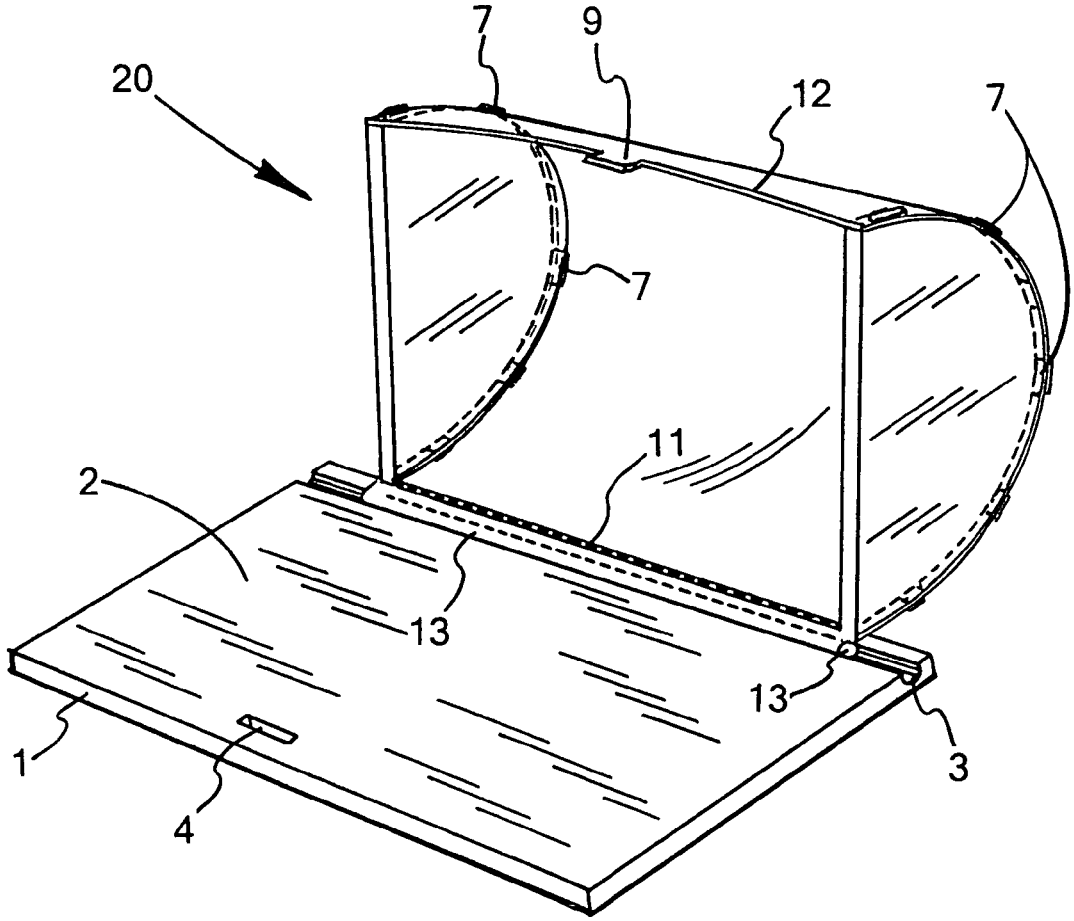
FIG. 2 is a perspective view of the collapsible food guard of FIG. 1 in the open (serving) position allowing access to any food (not shown) contained therein.

In FIG. 1, the base member 1 has a substantially planar upper surface 2 for engaging the plane formed by the bottom edges of the pivotable shield assembly (combined resilient transparent shield 5 and opposing side walls 8A and 8B) when the latter is in the closed (food display) position as shown in FIG. 1. This coplanar arrangement creates an effective seal between the shield assembly and the base member 1 for keeping bugs and the outside environment away from the food stored therein. In the embodiment of FIG. 1, the closed shield assembly does not extend over any of the edges of the stationary base member as shown in FIG. 1. To obtain the maximum protected area for any size of stationary base member, it is also within the scope of this invention that frontal edge 12 and/or side walls 8A and 8B extend just beyond the upper surface 2 of stationary base member 1 (not shown). The upper surface 2 of base member 1 has a hinge slot 3 running substantially parallel along the base member's 1 posterior edge, the slot 3 being sized and shaped for slideably engaging major hinge 13 member (not shown) that allows the pivotable shield assembly (5+8A+8B) to pivot as a unit as shown in FIG. 2. Optionally, the base member 1 has a notch 4 adjacent its frontal edge for engaging an optional peg or latch 9 when the pivotable shield assembly (5+8A+8B) is in the closed position as shown in FIG. 1.

FIG. 2 is a perspective view of the collapsible food guard 10 of FIG. 1 in the open (serving) position 20, allowing access to any food (not shown) contained therein. When the collapsible food guard is in the open position 20, frontal edge 12 of resilient transparent shield 5 will exhibit a natural bow, as shown, due to the resilient nature of the shield 5. Optionally, the frontal edge 12 of the resilient transparent shield incorporates a peg or latch 9 that will engage the stationary base member 1 to affect a reversible closure of the pivotal shield assembly. In the embodiment of FIG. 2, stationary base member 1 preferably has notch 4 for receiving optional latch (or peg) 9 when the pivotable shield assembly (5+8A+8B) of the collapsible food guard 20 is returned from the open position as shown in FIG. 2 to the closed position as shown in FIG. 1. The optional latch 9 may be shaped and sized to frictionally engage notch 4 along one or more of its sides. Latch (or peg) 9 may also be tapered at its attack end (the end distal to frontal edge 12) to facilitate entry into notch 4 before frictional engagement occurs higher up the shaft. However, to take advantage of the natural outward bowing of frontal edge 12, latch 9 preferably has a lateral rib (or protrusion) that engages a lateral groove (or dimple) on the internal front face of notch 4. This optional combination secures the pivotable shield assembly in the closed position. The latch 9 is unsecured simply by exerting thumb pressure above latch 9 to displace it backward, thereby countering the outward bow and disengaging the rib (or protrusion) from the lateral groove (or dimple) inside notch 4. Optionally, a thumb-sized area on the surface of the resilient transparent shield along its frontal edge 12 immediately above latch 9 is frosted or contains ribbing or indicia to indicate that it is the point for lifting. Other securing mechanisms that take advantage of the natural resilient pressure on the frontal edge 12 of shield 5 may also be optionally used, e.g., a ball on the end of a peg 9 that engages a dimple in notch 4. When present, the peg or latch 9 is preferably made of the same material as the resilient transparent shield 5. More preferably, the peg or latch 9 is coextruded with the resilient transparent shield 5 so that they are a single unitary piece.

Figure 3:
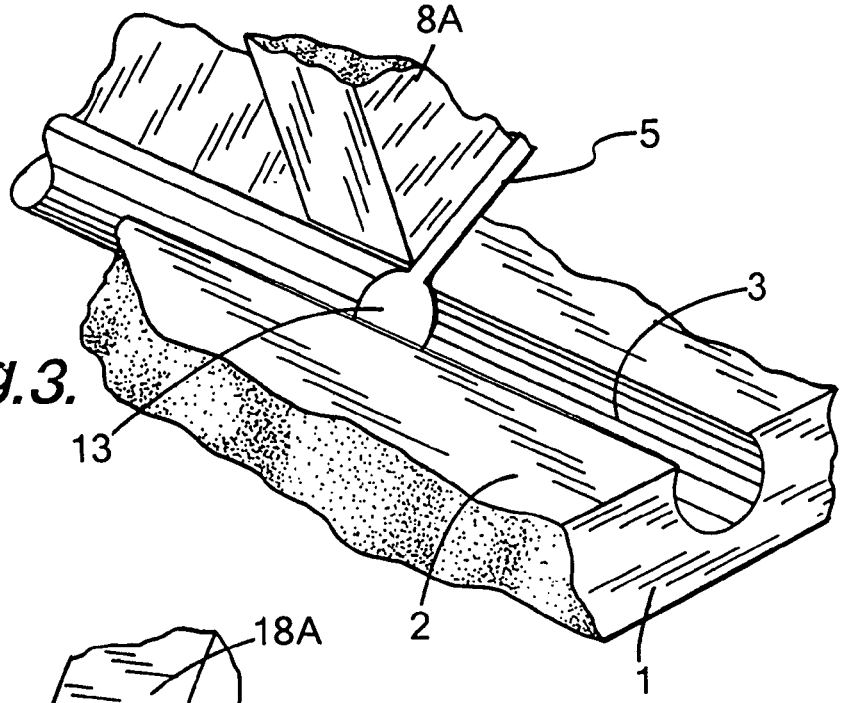
FIG. 3 is a close up view of the hinge region of the open collapsible food guard of FIG. 2.

FIG. 3 is a close up view of the hinge region of the open collapsible food guard 20 of FIG. 2. In FIG. 3, the hinge slot 3 on upper surface 2 of base member 1 is shown as having a preferred circular cross-section. In this embodiment, hinge slot 3 has a cross-section defined by a circular arc that is greater than 182° of arc but less than about 350° of arc, more preferably, from 188° of arc to about 245° of arc.

Hinge slot 3 is sized and shaped for slideably receiving a male hinge member 13. When the male hinge member 13 has a circular in cross-section, as shown in FIG. 3, and when the circular hinge slot 3 encompasses about 240° of circular arc as shown, then the male hinge member 13 can rotatably pivot about the 120° of open arc above the hinge slot 3. This embodiment produces little stress upon the male hinge member 13 or its connection along distal edge 11 to the resilient transparent shield 5. In this embodiment, male hinge member 13 and the resilient transparent shield 5 are preferably coextruded at the same time as a single unitary piece of plastic.

Because the resilient transparent shield 5 is resilient, it is also within the scope of this invention that the hinge connecting the resilient transparent shield 5 to the stationary base member 1 be a live hinge. A live hinge is created by simply reducing the size of the arc that is open above hinge slot 3 such that the male hinge member 13 is unable to rotate in hinge slot 3 and all pivoting of the shield assembly is by flexion of the resilient transparent shield 5 adjacent the male hinge member 13. When the hinge is a live hinge and the male hinge member is not required to rotate (or pivot) in the hinge slot 3, both the male hinge member 13 and the corresponding female hinge slot 3 may take on any shape, e.g., triangular, square, rectangular, inverted-T shape, without affecting the functionality of the collapsible food guard 10 of the invention. The male hinge member 13 is affixed to the distal edge 11 of the flexible transparent shield 5 by any technique that is well known in the art (e.g., gluing, ultra-sonic welding, riveting). Alternatively, the live hinge can be a separate element composed of a flexible polymer, having along its length a male hinge member 13 sized and shaped for sliding into the female hinge slot 3 and having along its opposing length a member for engaging the distal edge 11 of at the resilient transparent shield 5, such as by a slot, a glued seam, an ultrasonic weld, or a mechanical fastener, such as a plurality of rivets. However, the preferred method for connecting the male hinge member 13 (regardless of its shape) to the distal edge 11 of the resilient transparent shield 5 is by coextrusion of both as a single unitary piece.

Figure 4:
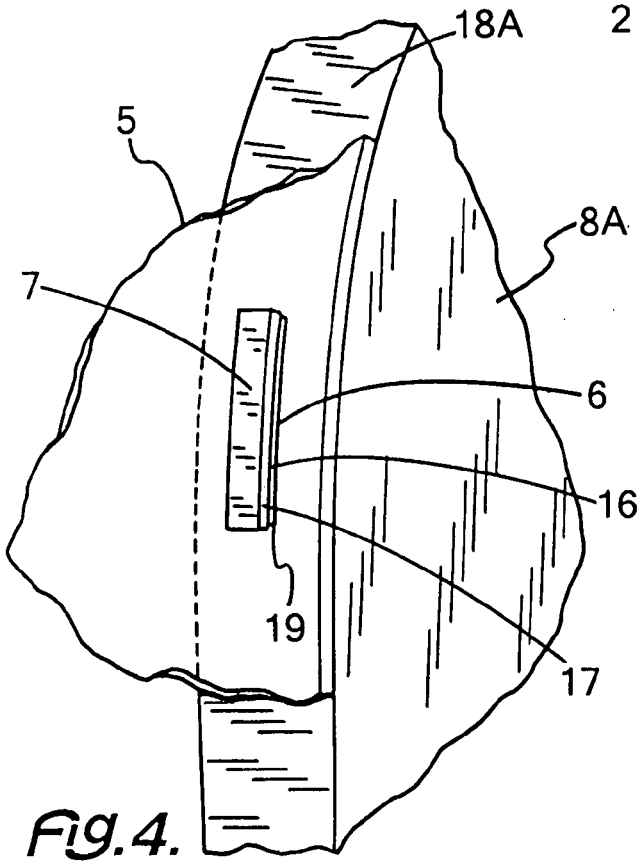
FIG. 4 is a close up view of the mortise and tenon type joinery that is used for reversibly attaching the lateral edges of the resilient transparent shield along the arched surfaces of the respective opposing walls.

FIG. 4 is a close-up view of the details of two types of mortise and tenon joints for reversibly retaining the lateral edges of the resilient transparent shield 5 in an arched position against the arched surfaces (18A and 18B) of side walls 8A and 8B, respectively. Because of the inherent resiliency in the arched sheet of plastic that comprises the resilient transparent shield 5, the arched shield 5 has a tendency to try to straighten out and pop off the tenons 7 protruding from the arched surface 8A (and 8B not shown). To overcome this tendency, the tenons are provided with a protrusion 17, such as a tapered nub or rib, along their lateral surface 16 that resists the mortise (slot) 6 in the resilient transparent shield from moving off the tenon without the further application of an external force greater than that exerted by the resiliency of the arched resilient transparent shield 5. Each of the nubs or ribs would extend outward from the width of the tenon by 0.4-8%, typically by 0.5-4%, more typically, by 0.5-3%. Alternatively, the lower edge of tenon 7 has a tenon notch 19 that retains the resilient transparent shield in the arched position. This notch exploits the natural tendency of the resilient transparent shield 5, when arched, to pull up and forward (i.e., to try to straighten), thereby engaging the notch. The holding effect of the notch 19 is released simply by pulling the shield 5 first downward to disengage the notches, and then forward to disengage the mortises (slots) 6 from their corresponding tenons 7.

Figure 5:
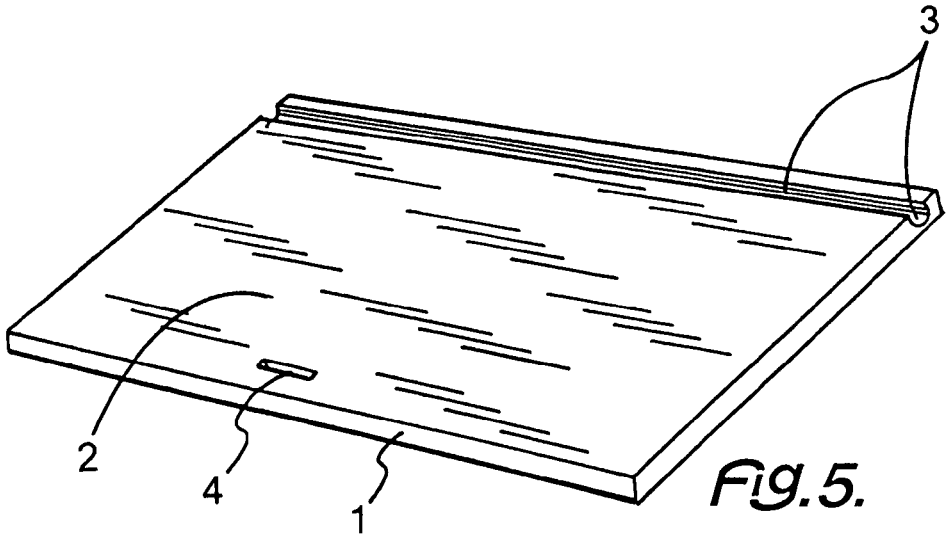
FIG. 5 is a solitary view of base member 1 as shown in each of FIGS. 1-3 with optional notch 4 and arcuate hinge slot 3.

FIG. 5 is a solitary view of stationary base member 1 as shown in each of FIGS. 1-3 with optional notch 4 and arcuate hinge slot 3. Optional notch 4 may be any shape suited to accommodate receipt of latch or peg 9. For ease of cleaning, notch 4 is optionally a through-hole extending through the entire thickness of stationary base member 1. When notch 4 has a rectangular opening, as shown in FIG. 5, it would accommodate receipt of a correspondingly rectangular shaped latch 9 on the frontal edge 12 of transparent shield 5 when the pivotable shield assembly (5+8A+8B) is pivoted to the down position as shown in FIG. 1. As discussed above, the optional latch (or peg) 9 may frictionally engage one or more sides or walls of the notch 4. In one embodiment, the attack end of the latch or peg is tapered to facilitate entry into notch 4. Optionally, the proximal wall of the notch 4 has a lateral groove (or dimple) for receiving a correspondingly shaped and positioned rib (or nub) protruding from latch 9. Typically, the hinge slot 3 is cut into stationary base member 1 using an appropriately shaped cutting tool such as a router blade corresponding in shape to the cross-sectional shape of the hinge slot that is desired. However, when the stationary base member 1 is plastic, the hinge slot 3 may be molded directly into the plastic. As discussed above, the stationary base member is made of any material that is suitable for contact with food. Typical suitable materials include wood (e.g., a plank or a laminated cutting board), plastics, stone (e.g., marble, granite, onyx), glass, composites (e.g., CORIAN®) or laminates (e.g., FORMICA®).

Figure 6:
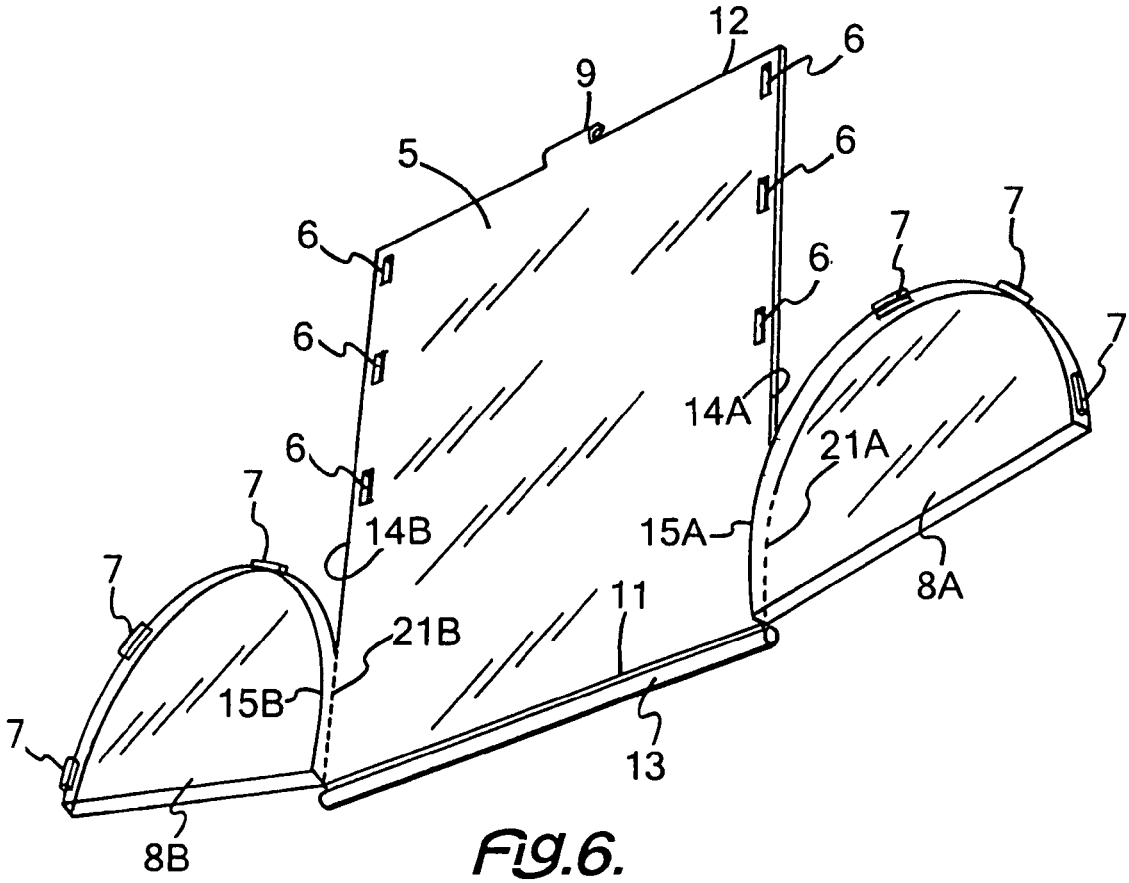
FIG. 6 is a view of the disassembled upper element of the collapsible food guard of FIGS. 1-4 in a collapsed substantially planar form, ready for assembly or storage.

FIG. 6 is a view of the disassembled upper element of the collapsible food guard of FIGS. 1-4 in a collapsed substantially planar form, ready for assembly or for storage. In FIG. 6, the resilient transparent shield 5 is shown in its natural flat form with optional latch 9 along frontal edge 12 and male hinge member 13 adjacent distal edge 11. Opposing side walls 8A and 8B are attached to opposing lateral edges 14A and 14B of resilient transparent shield 5 via opposing hinges 21A and 21B, respectively. While any hinge would be suitable for this function; preferably, the opposing hinges 21A and 21B are a live hinge as shown in FIG. 6. In the embodiment of FIG. 6, the resilient transparent shield 5 and lateral side walls 8A and 8B are coextruded as a single piece. Preferably, the opposing live hinges 21A and 21B are formed upon extrusion by simply reducing the thickness of the resilient transparent shield 5 at its point of attachment to side walls 8A and 8B respectively (i.e., along the hinge lines 21A and 21B), thereby forming a relatively weaker area between shield 5 and walls 8A and 8B, where bending would preferentially occur upon application of pivotal pressure. More preferably, resilient transparent shield 5, opposing side walls 8A and 8B, male hinge member 13A and latch or peg 9 are all coextruded as a single substantially planar piece as shown in FIG. 6. The natural resiliency in the plastic would cause the combined elements to assume the relaxed (collapsed) form shown in FIG. 6 when no mortise 6 and tenon 7 connections are made.

Less typically, opposing hinges 21A and 21B are formed after coextrusion along lateral edges 14 A and 14B of the coextruded form (5+8A+8B) by mechanically making a first bend between side wall 8A and shield 5 along edge 14A to create a preferential line of weakness that becomes hinge 21A. Likewise, a second bend is made between sidewall 8B and shield 5 along edge 14B to create a preferential line of weakness that becomes hinge 21B.

Figure 7:
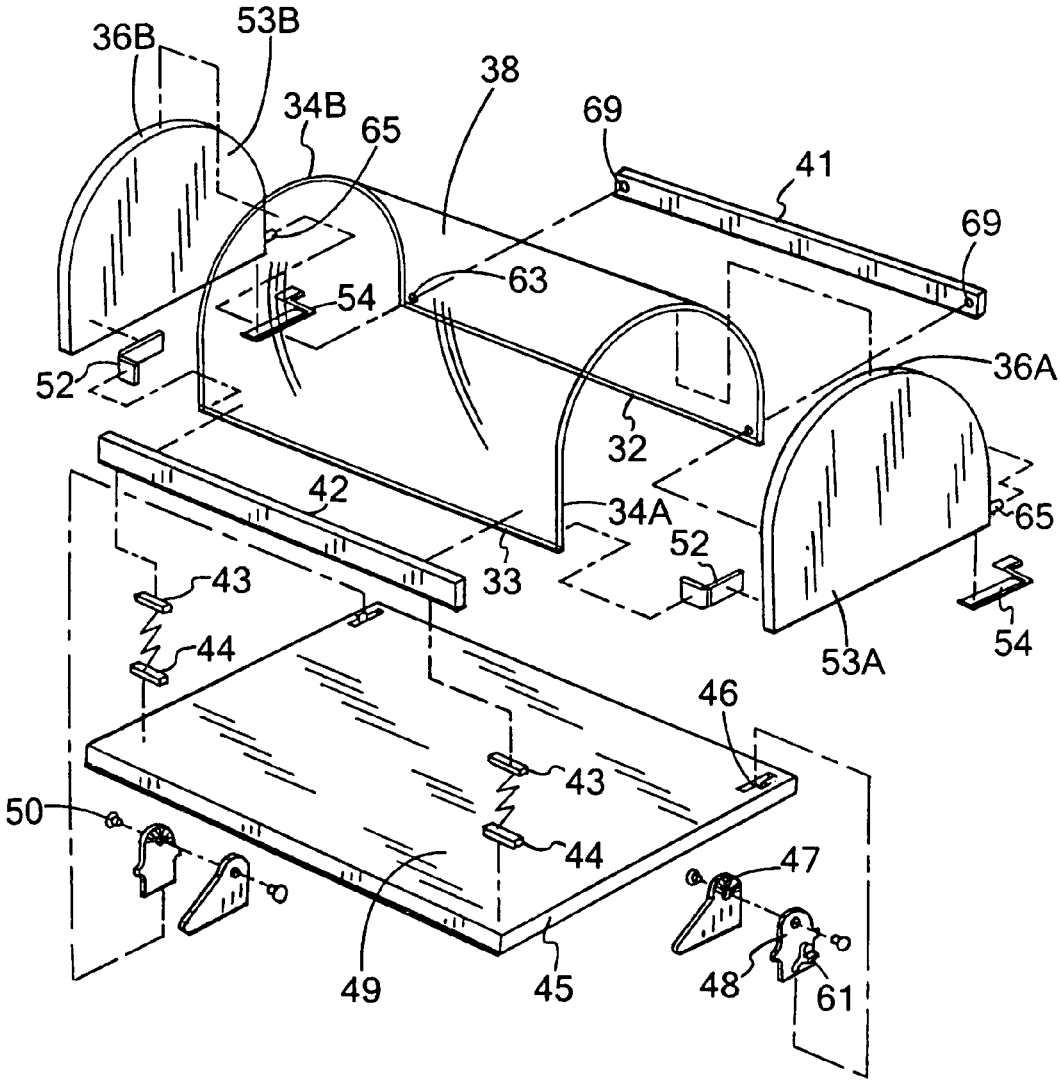
FIG. 7 is an exploded view of yet another embodiment of the collapsible food guard of the present invention.

FIG. 7 is an exploded view of another embodiment of a collapsible food guard of the present invention. In FIG. 7, the resilient transparent shield 38 has opposing lateral edges 34A and 34B that arch over and conform to the length and shape of arched surfaces 36A and 36B of opposing side walls 53A and 53B, respectively. The combination of the resilient transparent shield and the opposing side walls (the shield assembly) form a substantially semi-cylindrical canopy that substantially covers the planar upper surface 49 of a stationary base member 45. The stationary base member is made from any of the materials described herein. It is also within the scope of the invention that the base member 45 be a cutting board or be substituted with a service tray, service platter or perimeter frame. The resilient transparent shield 38 and the opposing sidewalls are made from the materials already described herein for the other embodiments. Unlike the other embodiments described herein, the embodiment of FIG. 7 has an optional anterior edge bar 42 and a posterior edge bar 41. The optional edge bars 41 and 42 stiffen the respective edges of the transparent resilient shield 38 and keep the anterior edge 33 and posterior edge 32 of the shield from excessive bowing. This allows one to use a thinner resilient transparent film as shield 38. The edge bars are made of the same or different material as the resilient transparent membrane. Preferably, the edge bars are made of the same material as the sidewalls. Suitable materials for the edge bars 41 and 42 include wood, metal or plastic. Suitable plastics include polyethylene, polypropylene, polycarbonate, polyvinyl chloride, polyethylene terephthalate, various methyacrylates and mixtures thereof. Preferably, the edge bars 41 and 42 are made of the same material as the resilient transparent shield 38. More preferably, when the edge bars 41 and 42 are made of the same material as the resilient transparent shield 38, the edge bars 41 and 42 and the resilient transparent shield are extruded or injection molded as a single unitary piece. Even more preferably, the resilient transparent shield 38, the side walls 53A and 53B, and the edge bars 41 and 42 are coextruded as a single unitary piece. The edge bars 41 and 42 also accommodate additional types of closures, and connections. Specifically, a magnet 44 emitting a magnetic field and a magnetically attractive catch plate 43 are suitable for use in combination as a latching mechanism for the closed shield assembly. In FIG. 7, separate magnetically attractive catch plates 43 are attached to opposing underside ends of anterior edge bar 42. When the resilient transparent shield is in the closed position (see FIG. 15), the magnetically attractive catch plates 43 engage two magnets 44 positioned below them on the substantially planar upper surface 49 of base member 45. The magnetic force between the magnets 44 and magnetically attractive catch plates provide a positive latching force for reversibly retaining the shield assembly in the closed position. Although FIG. 7 displays the magnets 44 on the base member 45 and the magnetically attractive plate 43 on the edge bar 42, it is also within the scope of the present invention that their relative positions be reversed. It is also within the scope of the present invention that the latching mechanism for the shield assembly comprises a single magnet 44 and single magnetically attractive catch plate 43 that are substantially centrally juxta-positioned along opposing faces of anterior edge bar 42 and the upper surface 49 of the base member 45. The magnet 44 is any permanent magnet, typically an iron magnet. The magnetically attractive catch plate 43 is typically a metallic plate comprising iron or an iron alloy. However, for increased holding power, the magnetically attractive catch plate 43 is optionally another permanent magnet with its N and S poles positioned to be opposite those of magnet 44 so as to be mutually attractive. When the edge bar 42 is made of iron, a separate magnetically attractive catch plate 43 is not needed since the iron edge bar 42 itself would also function as a magnetically attractive catch plate. In an alternative embodiment (not shown), the magnetic latch(s) of FIG. 7 are replaced with a mechanical latch such as the mortise and pin latch of FIG. 1.

In FIG. 7, the anterior lateral corner of the resilient transparent shield as defined by anterior edge 33 and lateral edge 34A is affixed to its opposing sidewall 53A by a living hinge 52. Likewise, the anterior lateral corner of the resilient transparent shield as defined by anterior edge 33 and lateral edge 34B is affixed to its opposing sidewall 53B by a living hinge 52. Preferably, these live hinge attachments are permanent such that the combination of the shield 38, opposing sidewalls 53A and 53B and the pair of hinges 52 are a single unitary piece. The live hinges 52 are permanently attached to the shield 38 and the opposing side wall by gluing, ultrasonic welding, or by the initial injection molding. More preferably, the combination of the shield 38, opposing sidewalls 53A and 53B and the pair of hinges 52 are formed at the same time by injection molding as a single unitary piece. Even more preferably, the combination of the shield 38, edge bars 41 and 42, opposing sidewalls 53A and 53B and the pair of live hinges 52 are formed at the same time by injection molding as a single unitary piece. Because the resilient transparent shield 38 is molded as a flat piece, it naturally assumes its substantially planar shape when not curved over the arched surfaces 36A and 36B of the opposing side walls 53A and 53B. Moreover, when not assembled, the opposing side walls 53A and 53B naturally fold along live hinges 52 to also form a planar shape that stacks over the planar transparent resilient shield 38. See FIG. 9. This planar shape facilitates storage in a minimum of space. Alternatively, the live hinge 52 could be a conventional pinned hinge (not shown). The collapsed shield assembly is converted into the assembled shield assembly by unfolding each of the opposing side walls along hinge 52 by 90° relative to the resilient transparent shield 38 and folding the lateral edges 36A and 36B of the resilient transparent shield 38 along the respective arched surfaces 36A and 36B of opposing sidewalls 53A and 53B until each of the corners along the posterior edge 32 of the resilient transparent shield engage a reversible latch at the bottom posterior end of arched surfaces 36A and 36B respectively. In FIG. 7, the reversible latch is shown as an anchor pin 65 protruding out of each of opposing lateral walls 53A and 53B. The anchor pin is sized and shaped for reversibly engaging first pin holes 63 along opposing posterior corners of shield 38 and second pin holes 69 along posterior edge bar 41. In one embodiment, the pins 65 frictionally engage the sides of pin holes 69 to reversibly retain the resilient transparent shield in a tensioned and arched configuration over arched surfaces 36A and 36B of opposing sidewalls 53A and 53B, respectively. Alternatively, as shown in FIG. 7, the anchor pins 65 extend beyond the second pin holes 69 and engage an edge clip 63 which provides the required resistance to reversibly hold shield 38 in the arched (and tensioned) position.

Figure 9:
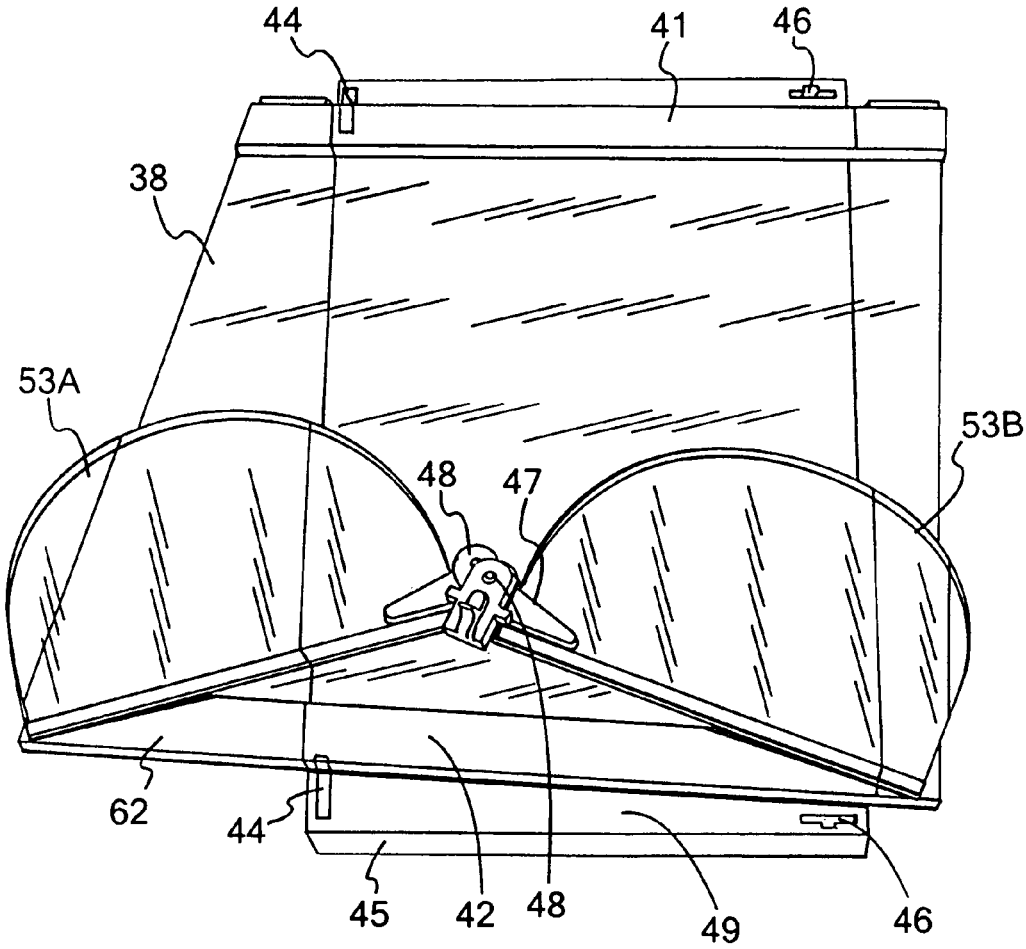
FIG. 9 is a view of the collapsible food guard of FIG. 7 in the disassembled and collapsed mode with the resilient transparent shield 38 assuming its substantially planar and relaxed position. In the collapsed mode, both the base 45 and the shield assembly 62 are substantially planar and storable in a minimum of space.

In FIG. 7, the assembled shield assembly is pivotably mounted to the stationary base member 45 by a pivoting mechanical hinge assembly separately attached to each of the opposing side walls 53A and 53B. The mechanical hinge typically has two hinge members and a hinge pin about which the hinge pivots. In the embodiment of FIG. 7, one of the hinge members 48 is stationary as it is bound to the stationary base member 45, and the pivotable hinge member 47 is pivotably mounted via hinge pin 50 to the outside surface of its respective sidewall. Stationary hinge members 48 reversibly mount into opposing hinge slots 46 in base member 45, thereby allowing the assembled and mounted shield assembly to pivotably open and close over the planar upper surface 49 of base member 45, exposing or covering its contents, respectively. Because the first hinge member is reversibly attached to the base member 45, the assembled shield assembly can be readily removed from the base member 45 and readily disassembled from arched to planar form as shown in FIG. 9. The pivotable hinge member 47 is attached to the outside face of its opposing side wall by any means known in the art, including screws, adhesive, ultrasonic welding and integral construction. Thus, it is within the scope of the present invention that the pivotable hinge member 47 and the opposing sidewall 53A or 53B to which it is attached be coextruded as a single unitary piece.

Figure 8:
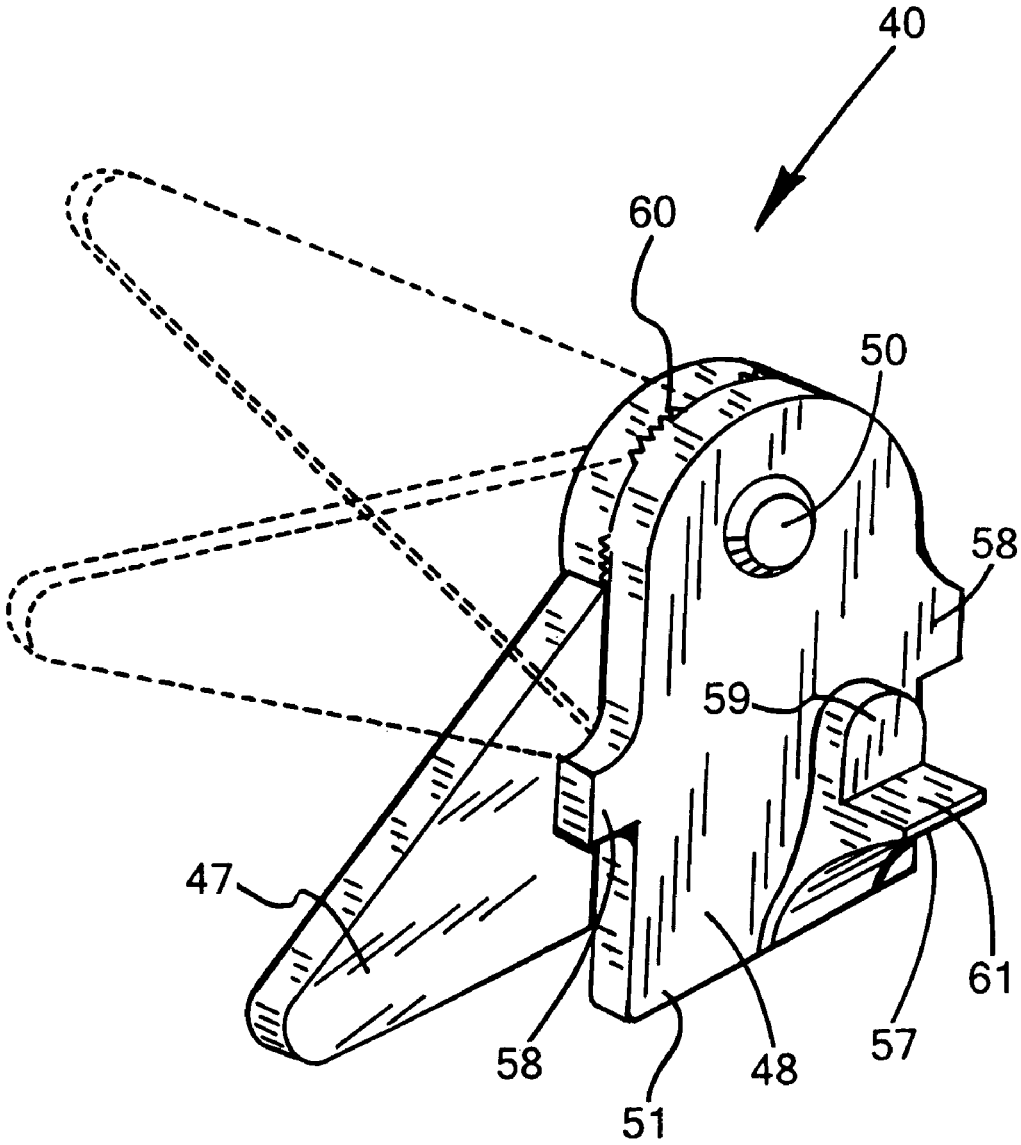
FIG. 8 is an close-up view of one opposing hinge 40 suitable for use in pivotably opening and closing the shield assembly of FIG. 7 relative to its substantially planar base member 45.

FIG. 8 is an close-up view of one opposing hinge assembly 40 suitable for use in pivotably opening and closing the shield assembly of FIG. 7 relative to the stationary and substantially planar base member 45. The hinge assembly comprises stationary hinge member 48 pivotably connected to pivotable hinge member 47 by hinge pin 50. The inside faces of stationary hinge member 48 and pivotable hinge member 47 have two series of nubs or teeth 60 that in various degrees of pivot engage one another to form a position brake where the increased resistance from the interacting nubs provides reversible stops that hold the hinge in a partially open (venting) position or in a fully open position. See FIG. 8. The resistance created by the engaging nubs 60 is sufficient to hold the shield assembly in partially open position (FIG. 16) or the fully open position (FIG. 14) but is readily overcome by application of hand pressure. In FIG. 8, stationary hinge member 48 has a lower portion that is an anchor key 51 that is sized and shaped for securely sliding into slot 46 on the upper surface 49 of base member 45 and anchoring the stationary member 48 of the hinge assembly 40 when it is pivotably connected to the pivotable shield assembly. The depth that the anchor key 51 sinks into slot 46 is controlled preferably by a pair of protruding stop rests 58. The stop rests allow one to see that the anchors are fully pressed into the slots and assure that both hinges are at the same depth and properly aligned. Preferably, stationary hinge member 48 has a lock and release latch 61 with lip 57 (for engaging a corresponding notch in slot 46) and a pressure release tab 59 (for disengaging lip 57 from the notch (not shown) in slot 46). In this embodiment, stationary hinge member 48 has a T-shaped footprint and slot 46 is correspondingly T-shaped as shown in FIG. 7 to accommodate the footprint. As already discussed herein, it is also within the scope of this invention that the pivotable hinge member 47 be of unitary construction with its respective wall member; preferably, the opposing wall member (53A or 53B) and its corresponding pivotable hinge member 47 be injection molded at the same time as a single unitary piece of plastic.

FIG. 9 is a view of the collapsible food guard of FIG. 7 in the disassembled and collapsed mode with the resilient transparent shield 38 assuming its substantially planar and relaxed position. In the collapsed mode, both the base 45 and the shield assembly 62 are substantially planar and storable in a minimum of space.

Figure 10:
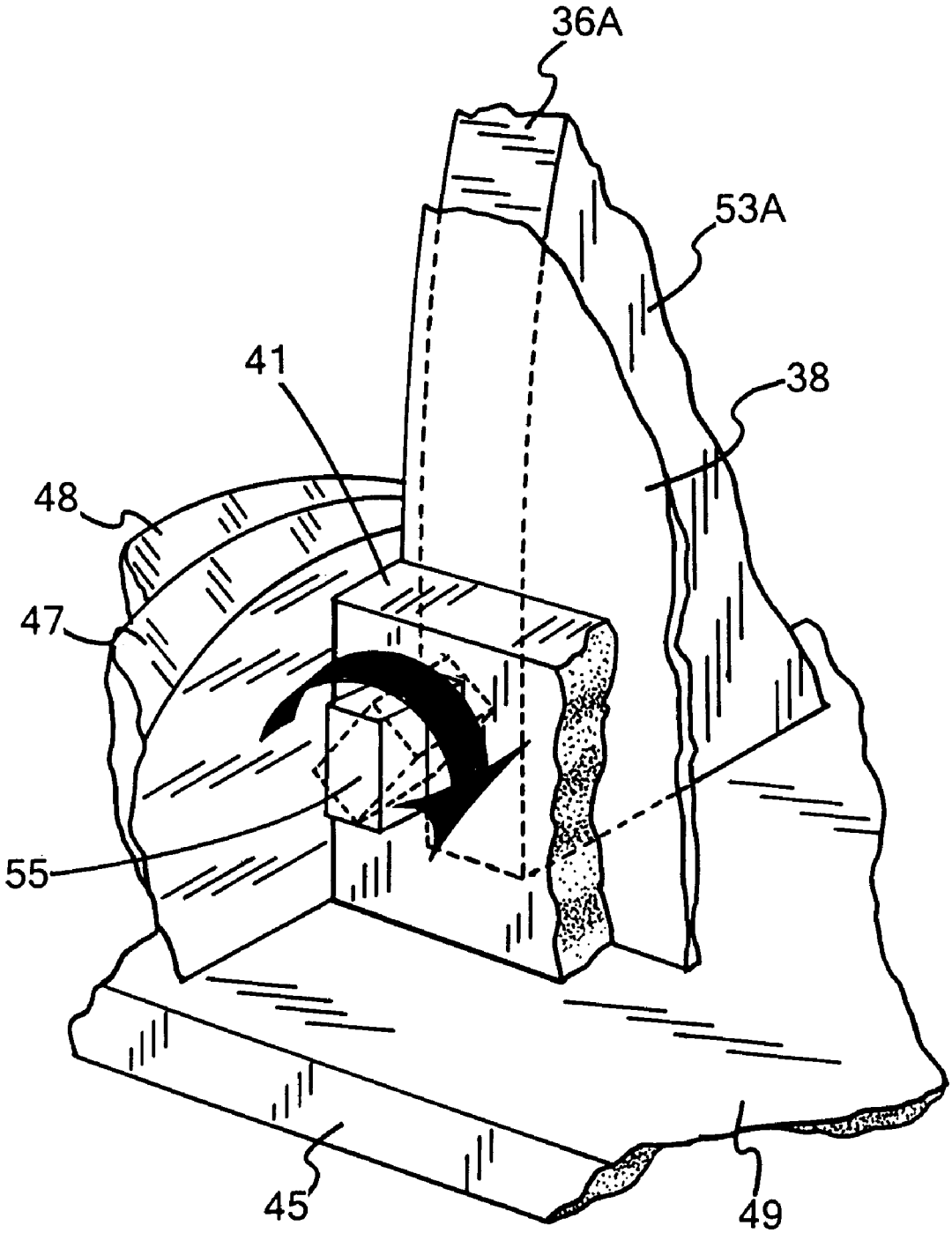
FIG. 10 is a view of an optional restraint for restraining the resilient transparent shield in a tensioned and arched position against the arched surface of an opposing sidewall.

FIG. 10 is a view of an optional restraint for restraining the resilient transparent shield in a tensioned and arched position against the arched surface of an opposing sidewall. In FIG. 10, the restraint is a twistable shield mount latch 55. The twistable shield mount latch has a stationary segment and a twistable (or rotatable) segment. The stationary segment is affixed near the bottom posterior end of arched surface 36A of opposing side wall 53A and extends outward from the arched surface 36A a distance equal to at least the combined thickness of the shield 38 and the posterior edge bar 41. The twistable portion begins at distance from the arched surface that is at least the combined thickness of the shield 38 and the edge bar 41 which it reversibly restrains. Although the twistable portion of latch 55 is shown in FIG. 10 as a rectangular block, other oblong rotatable restraining devices, such as a butterfly or wing nut, may alternatively be screwed into the stationary portion of latch 55. In use, a relevant portion of the shield 38 and the posterior edge bar 41 each have a hole or slot sized and shaped for sliding over the latch 55 when twisted in the open position. Once the shield 38 and edge bar 41 have slid over the latch and against the arched surface 36A of the wall 53A, the twistable oblong portion of latch 55 is rotated so that its wider dimension engages the outside surface of the posterior edge bar 41 and restrains it and the shield in the arched position as shown. Although the restraint of FIG. 10 is shown for one opposing side wall 53A, it is equally applicable to the other opposing side wall 53B for restraining the opposing edge of the resilient transparent shield 38 against arched surface 36B. It is also within the scope of the present invention that the stationary segment of the twistable shield mount latch 55 be integrally attached to its respective opposing wall; preferably, the side wall and the stationary portion of latch 55 is injection molded at the same time as a single piece of plastic.

Figure 11:
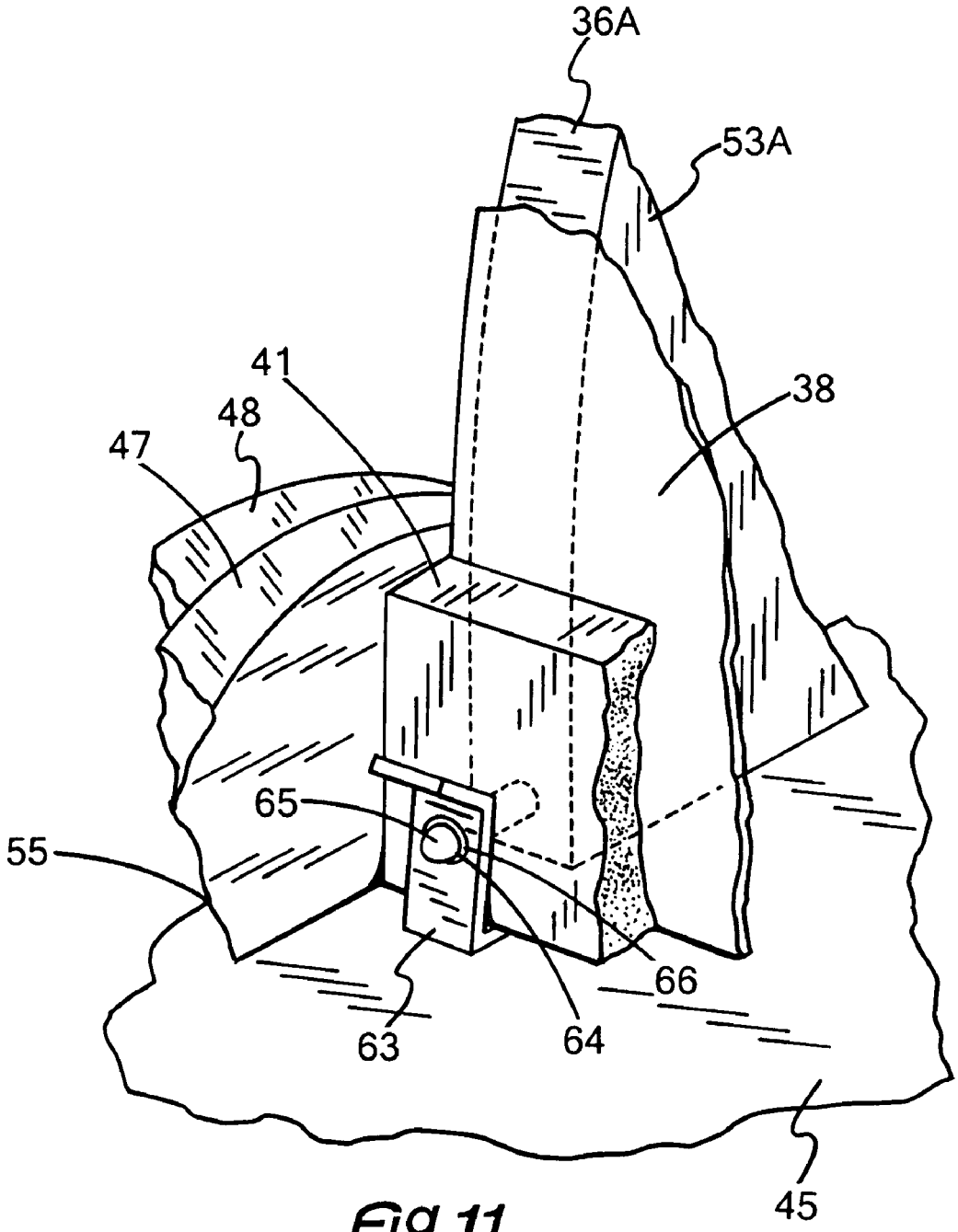
FIG. 11 is a view of another optional restraint device for restraining the resilient transparent shield in a tensioned and arched position against the arched surface of an opposing sidewall.

FIG. 11 is a view of another optional restraint device for restraining the resilient transparent shield in a tensioned and arched position against the arched surface of an opposing sidewall. The restraint in FIG. 11 is a detailed view of one embodiment of the restraint depicted in use in the collapsible food guard of FIG. 7. In FIG. 11, an anchor pin 65 projects out adjacent the posterior end arched surface 36A. The length of anchor pin 65 depends upon its function. In use, transparent shield 38 and posterior edge bar 41 have first pin hole 63 and second pin hole 69, respectively. When anchor pin 65 restrains shield 38 by passing through first pin hole 63 and frictionally engaging the sides of second pin hole 69, then the anchor pin may but need not be longer than the combined thicknesses of the shield 38 and the posterior edge bar 41. However, if the anchor pin 65 does not frictionally engage the inside surface of the second pin hole 69 sufficiently to restrain the shield 38 in the arched position, then the anchor pin 65 needs to have a length that is sufficiently longer than the combined thicknesses of the shield 38 and posterior edge bar 41 so as to engage a retaining clip. Typically, this additional length is within the range of ⅛ inch to ½ inch. In the embodiment of FIGS. 7 and 11, the anchor pin 65 sticks out sufficiently beyond the edge of posterior edge bar 41 so that a retaining clip 63 with a circular aperture 64 frictionally engages anchor pin 65, thereby restraining shield 38 against arched surface 36A in a reversible manner. Alternatively, anchor pin 65 is slotted for receiving a U-shaped retaining clip wherein the inside gap in the U-shaped clip is the diameter of the notch (not shown). When the shield 38 and the posterior edge bar 41 are slid over the notched anchor pin, the notch projects beyond the edge bar 41 and the U-shaped clip is slid into the notch and the shield 38 and posterior edge bar 41 are restrained against arched surface 36A in a reversible manner. Although the restraint of FIG. 11 is shown for one opposing side wall 53A, it is equally applicable to the other opposing side wall 53B for restraining the opposing edge of the resilient transparent shield 38 against arched surface 36B. It is within the scope of the present invention that the anchor pin be integrally attached to its respective opposing wall, such as by screwing, adhesives or ultrasonic welding. Preferably, the side wall and the corresponding anchor pin 65 are injection molded at the same time as a single piece of plastic. Moreover, any parts that are described herein as being injection molded with a side wall are capable of being injection molded in combination with all other parts so described as a single unitary piece.

Figure 12:
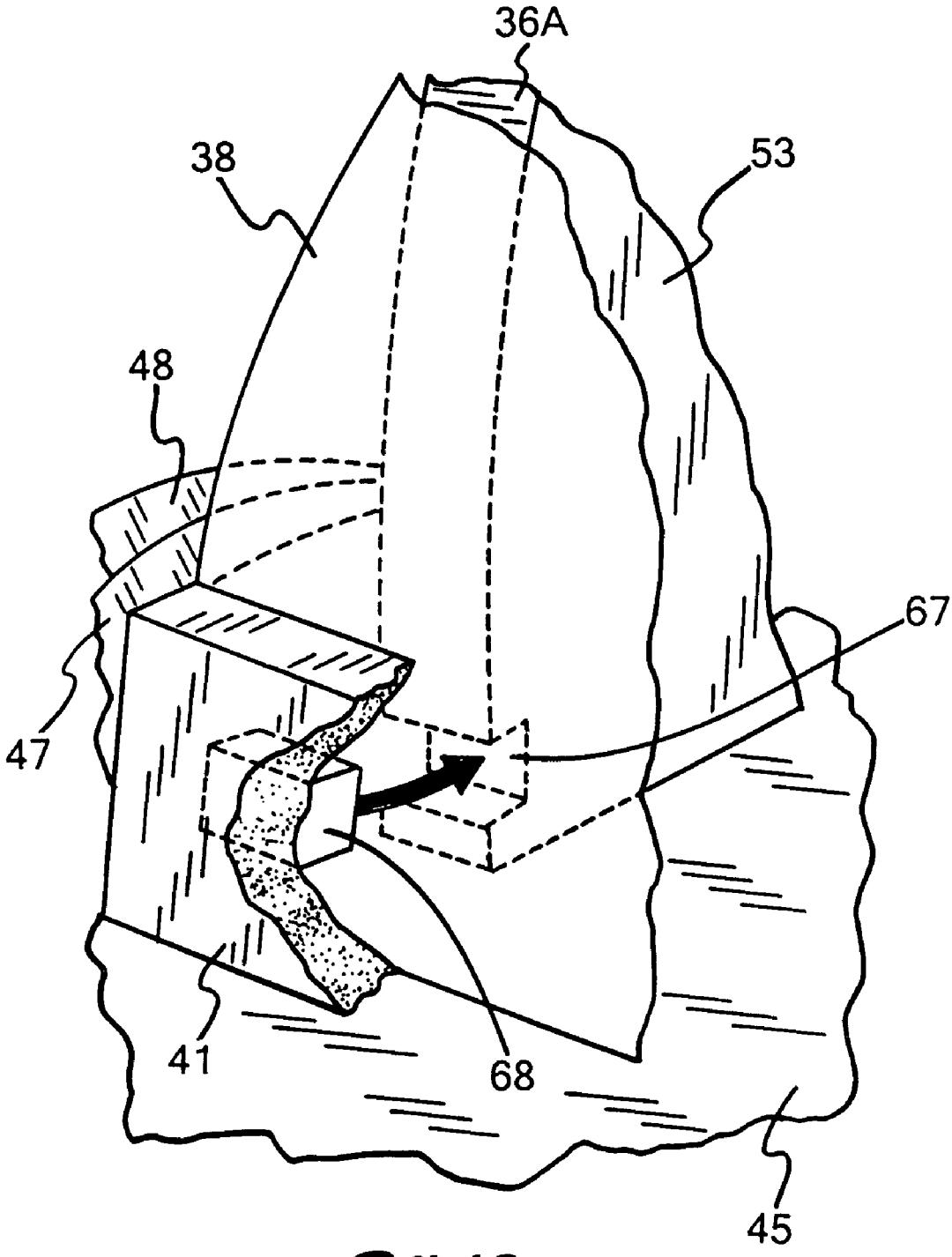
FIG. 12 is a view of yet another optional restraint device for restraining the resilient transparent shield in a tensioned and arched position against the arched surface of an opposing sidewall.

FIG. 12 is a view of yet another optional restraint device for restraining the resilient transparent shield in a tensioned and arched position against the arched surface of an opposing sidewall. In FIG. 12, the opposing ends of posterior edge bar 41 each have a key block 68 projecting therefrom sized and positioned for frictionally engaging a key slot 67 in the lower posterior end of arched surface 36A of side wall 53A. The friction in the slot should be sufficient to overcome the resilient tension in the shield 38 produced by its arching but not so high as to prevent its easy removal when storage is needed. Typically, no more than 10 lbs of force should be required.

Figure 13:
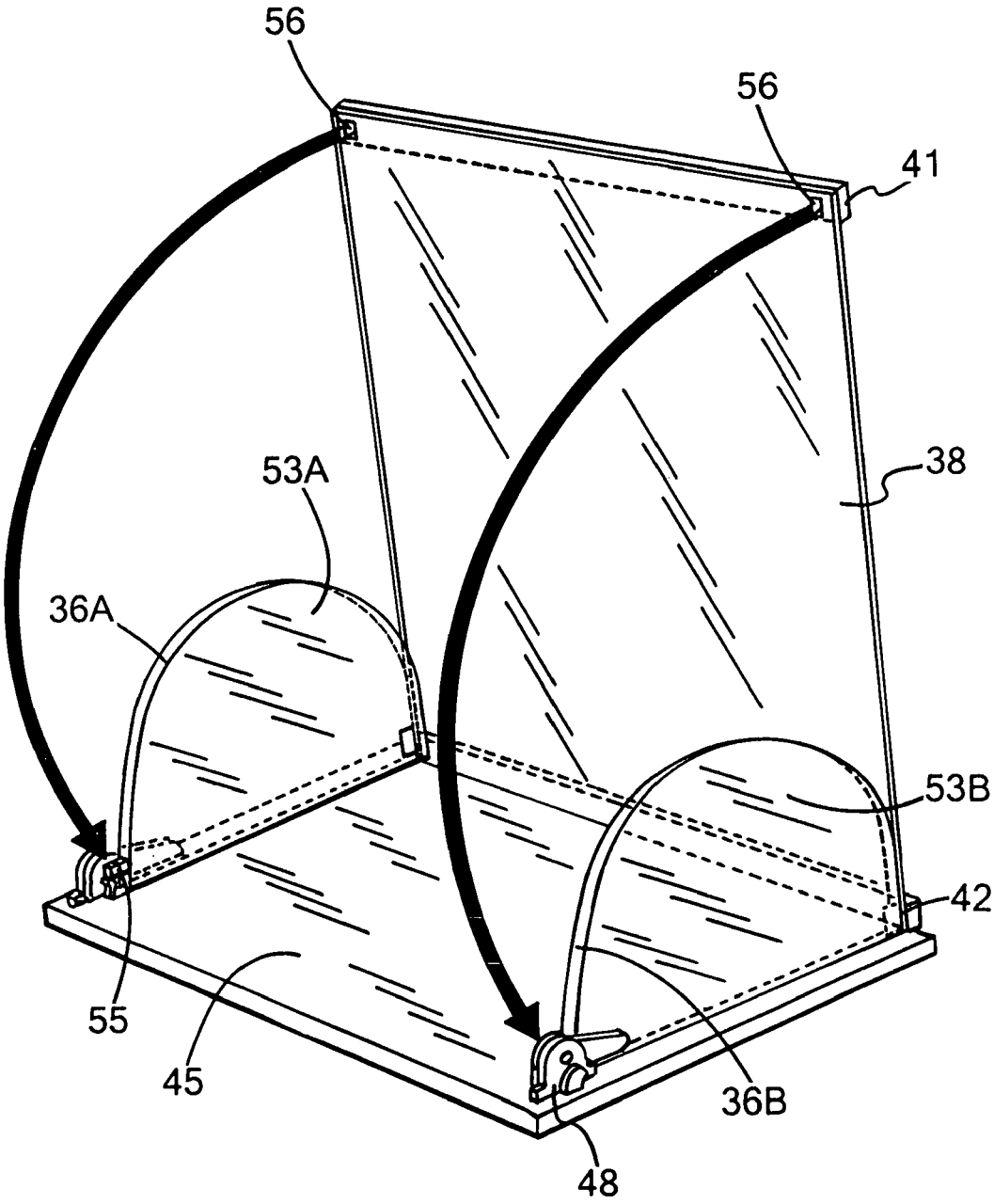
FIG. 13 is a view of the semi-assembled embodiment of FIG. 10 wherein the resilient transparent shield 38 is in its natural flat position before being flexed to an arched position so as to engage the arched surfaces of the opposing side walls and their respective twistable shield mount latches 55 to form a collapsible food guard in the closed position such as shown in FIG. 15.
Figure 15:
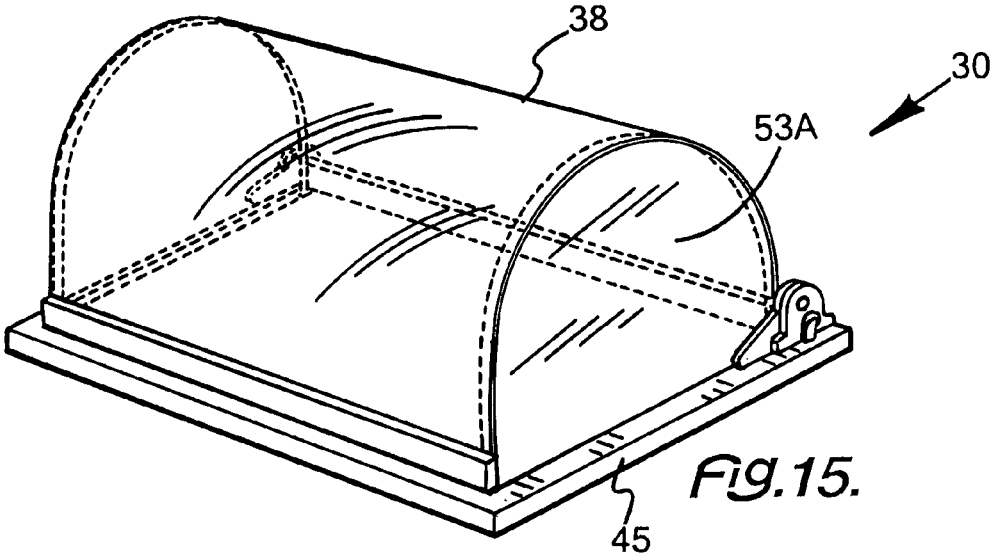
FIG. 15 is a view of the collapsible food guard of FIG. 7 in the closed position.

FIG. 13 is a view of the semi-assembled embodiment of FIG. 10 wherein the resilient transparent shield 38 is in its natural flat position before being flexed to an arched position so as to engage the arched surfaces 36A and 36B of the opposing side walls 53A and 53B, respectively, and their respective twistable shield mount latches 55 which engage opposing latch slots 56 to form a collapsible food guard in the closed position such as shown in FIG. 15.

Figure 14:
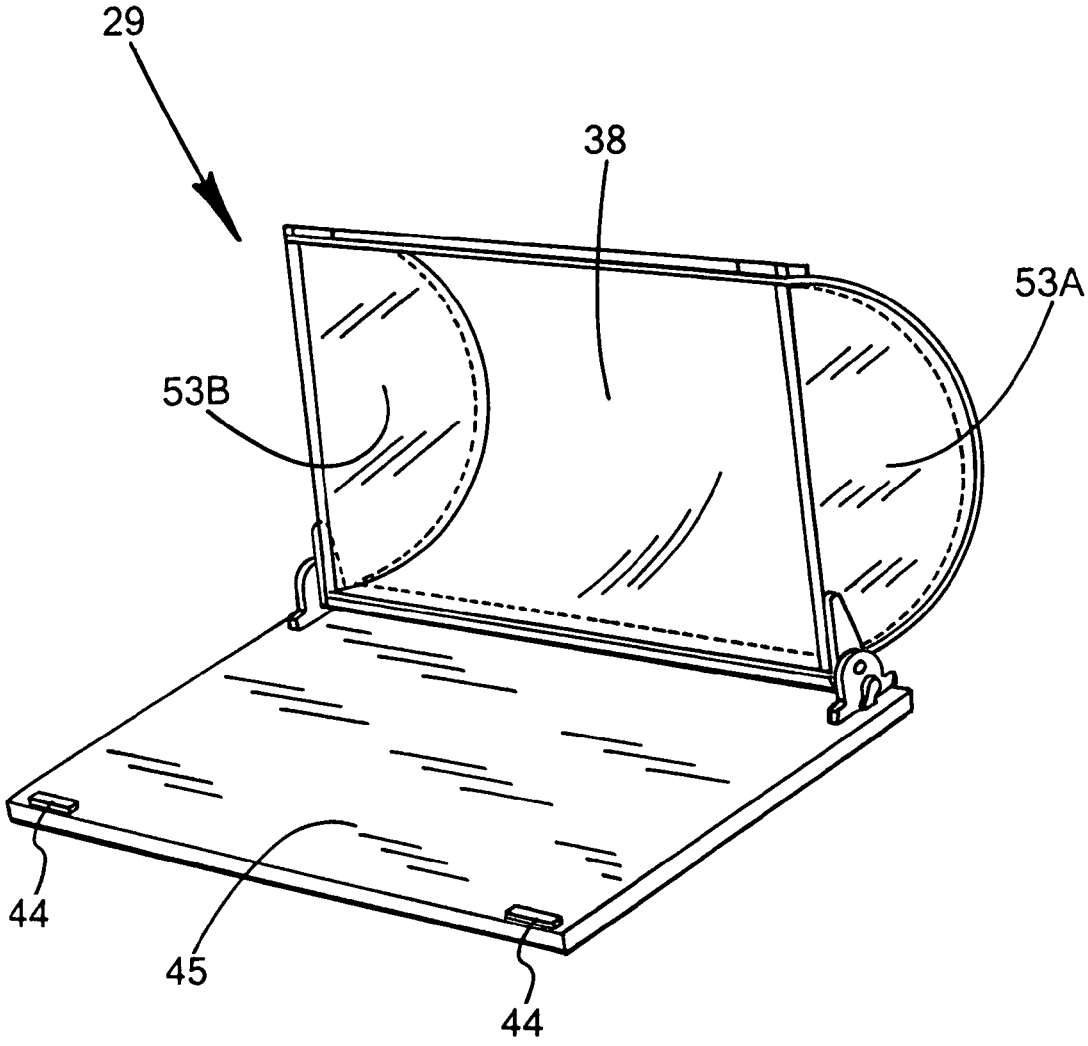
FIG. 14 is a view of the collapsible food guard of FIG. 7 in the fully open position.

FIG. 14 is a view of the collapsible food guard of FIG. 7 in the fully open position. This figure also depicts when a second group of brake nubs or teeth 60 of the hinge assembly 40 catch or engage one another and provide sufficient resistance to hold the weight of the pivotable shield assembly in a substantially fully open position.

FIG. 15 is a view of the collapsible food guard of FIG. 7 in the closed position.

Figure 16:
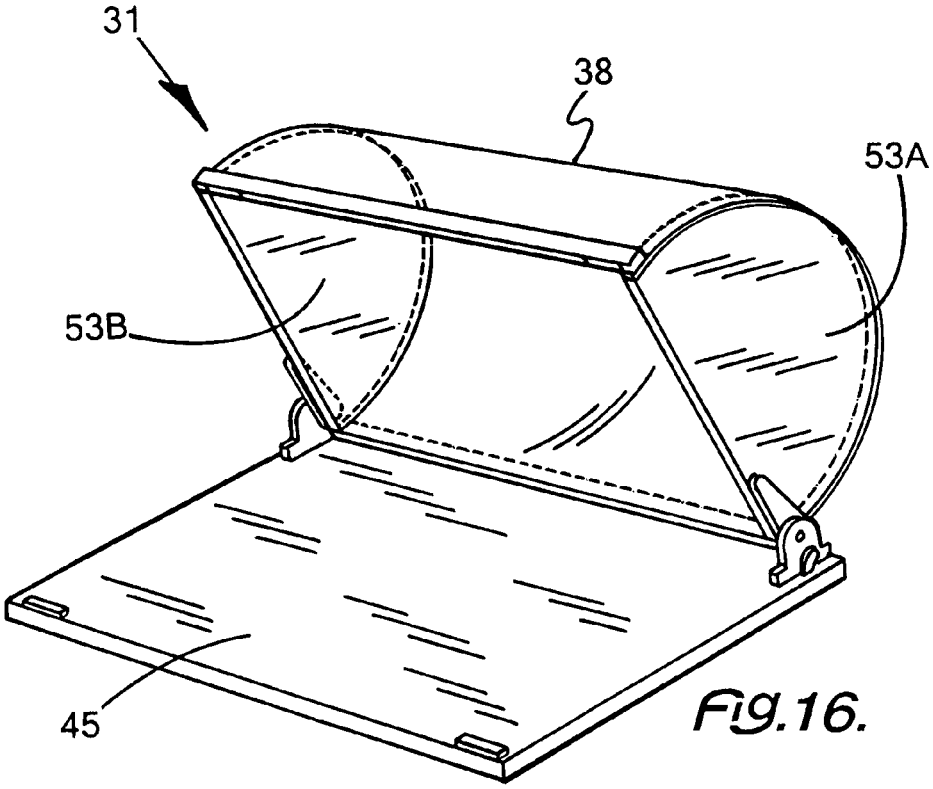
FIG. 16 is a view of the collapsible food guard of FIG. 7 with the hinge of FIG. 8 in the partially open position.

FIG. 16 is a view of the collapsible food guard of FIG. 7 with the hinge of FIG. 8 in the partially open position. This figure depicts when a first group of brake nubs or teeth 60 of the hinge assembly 40 catch or engage one another and provide sufficient resistance to hold the weight of the pivotable shield assembly in the partially open position.

Although the opposing side walls of FIGS. 7-16 do not show any vents, it is also within the scope of this invention that the opposing side walls optionally include opposing vents so as to minimize condensation caused by storing hot foods underneath. As discussed herein, such vents are either a series of slits in the side wall of screens. Preferably, the vents are screens. The screens are either inserted in windows after molding or are premolded into the walls. More preferably, the screens, when present, are premolded into the side walls during the injection molding process.

Figure 17:
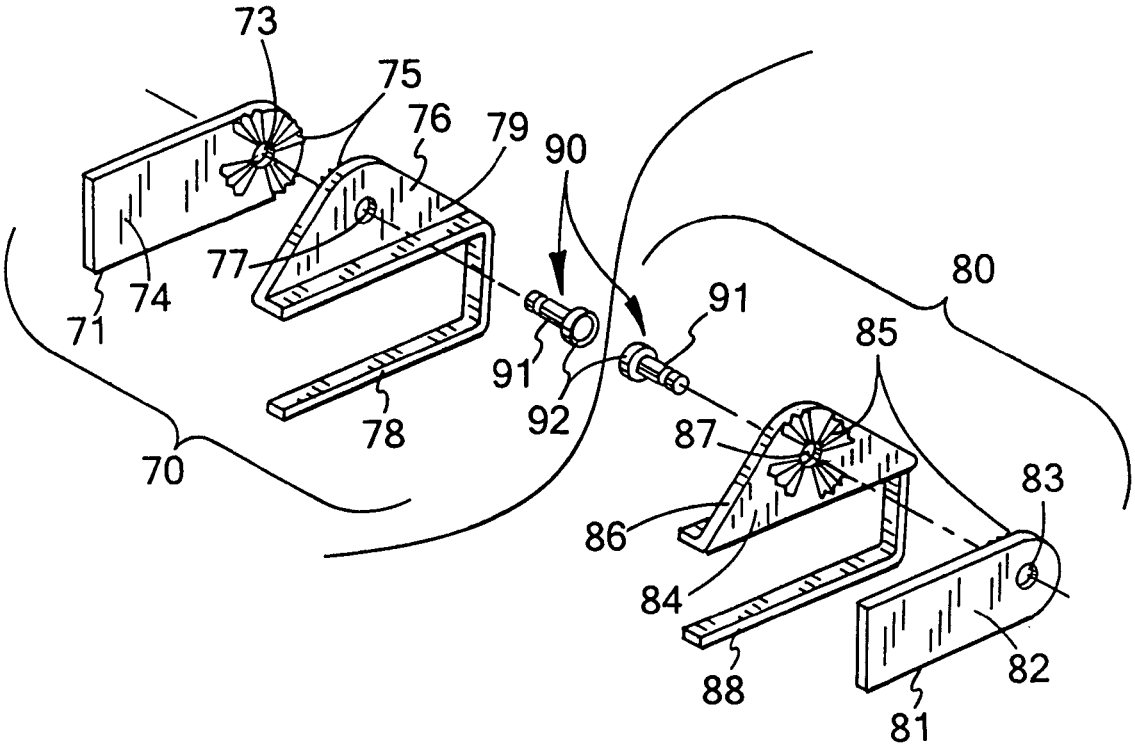
FIG. 17 is an exploded view of an opposing pair of alternative hinges for slideably and reversibly attaching the pivotable shield assembly to the stationary base member.

FIG. 17 is an exploded view of an opposing pair of alternative hinges for slideably and reversibly attaching the pivotable shield assembly to the stationary base member. In FIG. 17, right side hinge 70 and left side hinge 80 are mirror images of one another. Right side hinge 70 is an assembly comprising pivotable hinge member 71, stationary hinge member 76 and pin 90 for pivotably interconnecting hinge members 71 and 76. Pivotable hinge member 71 has hinge side face 74, which faces the opposing hinge member 76, and wall side face 72 (not shown) which is affixed to the outside face of the right opposing sidewall (not shown), such as sidewall 8A in FIG. 1 in lieu of live hinge 13, or to sidewall 53A in FIG. 7 in lieu of pivotable hinge member 47. Optionally, hinge side face 74 has raised ribs or teeth 75 that interact with raised (or depressed) ribs or teeth 75 on the hinge side surface (not shown) of stationary hinge member 76. The corresponding teeth or ribs can be seen on the hinge side surface 84 of the mirror image stationary hinge member 86. When the opposing teeth or ribs 75 engage one another, they create a temporary stopping point for the hinge assembly that is overcome by applying additional force. In one embodiment, the opposing teeth 75 are positioned to engage each other when the pivotable shield assembly is in the fully open position. In another embodiment, the opposing teeth 75 are positioned to engage each other when the pivotable shield assembly is in the partially open position. In yet another embodiment, the opposing teeth 75 are positioned to engage each other both when the pivotable shield assembly is in the partially open position and when it is in the fully open position. The pivotable hinge member 71 and the stationary hinge member 76 are held in a pivotable relationship to one another by pin 90 when it engages both pin hole 74 in stationary hinge member 76 and pin hole 73 in pivotable hinge member 71. In FIG. 17 pin 90 has a cylindrical shaft 91, which allows for pivoting. To retain pin 90 in an operative position in both pin holes, either pin hole 73 or pin hole 77 has a diameter sufficiently small to frictionally engage cylindrical shaft 91 when it is inserted in the pin hole. Preferably, the pin hole on the pivotable hinge member frictionally engages the shaft 91 of pin 90 and reversibly retains it in position, whereas the diameter of pin hole 77 on the opposing hinge member 76 is sufficiently large so that the shaft 91 rotates freely in the pin hole 77. The stationary hinge member 76 has a U-shaped clip 78 horizontally positioned below its outside face 79. The U-shaped clip 78 has its respective side arms gapped for slideably receiving and frictionally engaging the corresponding upper and lower surfaces of a stationary base member (not shown). Although the gap in the U-shaped clip may be any size to slideably accommodate the thickness of the stationary base member, typically, the gap between the opposing arms of the U-shaped clip 78 is between ¼ inch and 1 inch. More typically, the gap is within the range of ⅜ inch to ¾ inch.

The left side hinge assembly 80 is just a mirror image of right side hinge assembly 70. The left side hinge assembly 80 comprises pivotable hinge member 81, stationary hinge member 86 and hinge pin 90. As shown in FIG. 17, when pivotable hinge member 81 is symmetrical, it is identical to hinge member 71. However, it is within the scope of this invention that the pivotable hinge members not be symmetrical, such as the pivotable hinge member 47 of FIG. 7. Pivotable hinge member 81 has side wall engaging surface 82, pin hole 83 and teeth or ribs 85 as described for hinge member 71. Stationary hinge member 86 has hinge engaging surface 84 with ribs or teeth 85 around pin hole 87 and U-shaped clip 88 for slideably receiving and frictionally engaging the corresponding upper and lower surfaces of a stationary base member (not shown). When pin holes 87 and 83 are aligned and hinge pin 90 is inserted in both pin holes, left side hinge assembly 80 is formed. The diameters of the pin holes 87 and 83 are as discussed for their mirror image members 73 and 77. Right side hinge assembly 70 and left side hinge assembly 80 are typically matched so that their teeth 75 and 85, respectively, engage at the same position or positions. Thus, in one embodiment, the opposing teeth 75 on the right (85 on the left) are positioned to engage on each respective side when the pivotable shield assembly is in the fully open position. In another embodiment, the opposing teeth 75 on the right (85 on the left) are positioned to engage on each respective side when the pivotable shield assembly is in the partially open position. In yet another embodiment, both sets of opposing teeth (75 and 85) are positioned to engage on their respective sides both when the pivotable shield assembly is in the partially open position and when it is in the fully open position.

Pivotable hinge members 71 and 81 are affixed to their respective sidewalls by any of the methods described herein for affixing the other pivotable hinge members. Such methods for attachment are well known in the art. In a preferred embodiment, the pivotable hinge members 71 and 81 are integrally attached to the side walls by being injection molded simultaneously with the side walls as a single unitary piece. When a pair of pivotable hinge members 70 and 80 are used to reversibly affix a shield assembly to a stationary base member, the stationary base member can be any base member as already described herein (including a platter or tray) and does not require a proprietary base member having hinge slot 3, as in FIG. 1, or having a pair of opposing hinge slots 46 as in FIG. 7. Thus, in another embodiment, a resilient transparent shield assembly comprising a resilient transparent shield and opposing side walls having slideable hinge assemblies 70 and 80 is a stand alone invention in itself. This latter invention is usable with the consumer's existing base member, albeit a cutting board, a tray or a platter. Preferably, this resilient transparent shield assembly is a one piece device wherein the shield and side walls are assembleable and collapsible as described herein.

It is intended that the invention not be limited to the particular embodiments disclosed. The features in one embodiment are useful in any of the embodiments. It is intended that the invention include all embodiments falling within the scope of the appended claims.

The invention claimed is:

1. A collapsible food guard for displaying and serving food comprising a resilient transparent cover assembly for a substantially planar base member, said cover assembly comprising a planar resilient transparent shield that has been arched to be substantially semi-cylindrical of a predetermined radius and reversibly engaging along its opposing edges two similarly arched walls that provide said cover assembly with closed opposing ends, said cover assembly being reversibly pivotably attached to said base member and having downward facing edges to seal said cover assembly to said base member when said cover assembly is pivoted in the down position, said cover assembly exposing said base member and any contents thereon when said cover assembly is pivoted in the up position, said cover assembly having a hinge member reversibly mounted to said substantially planar base member, said shield being reversibly detachable from the arched surface of each of said opposing end walls and assuming a planar shape upon detachment to facilitate storage.

2. The collapsible food guard of claim 1 wherein the hinge member is a live hinge.

3. The collapsible food guard of claim 1, wherein the hinge member is a mechanical hinge having a hinge pin.

4. A collapsible food guard for displaying and serving food comprising a substantially planar base member and a resilient transparent cover for said base member, said cover comprising a planar resilient transparent shield that has been arched to be substantially semi-cylindrical of a predetermined radius and engaging two similarly arched walls that provide said cover with closed opposing ends, said cover being reversibly pivotably attached to said base member and having downward facing edges to seal said cover to said base member when said cover is pivoted in the down position, said cover exposing said base member and any contents thereon when said cover is pivoted in the up position, said cover having a male hinge member for slideably disengaging from said planar base member, said shield being reversibly detachable from at least one end of each of said end walls and assuming a planar shape upon detachment to facilitate storage.

5. The collapsible food guard of claim 4, wherein the resilient transparent shield is made from a plastic selected from the group consisting of polycarbonate, polyethylene terephthalate and polyvinyl chloride.

6. The collapsible food guard of claim 5, wherein the plastic is a polycarbonate.

7. The collapsible food guard of claim 5, wherein the substantially planar base member is wood, plastic, glass, stone, ceramic or a stone composite.

8. The collapsible food guard of claim 7, wherein the substantially planar base member is wood.

9. The collapsible food guard of claim 7, wherein the substantially planar base member is plastic.

10. The collapsible food guard of claim 9, wherein the plastic is melamine.

11. The collapsible food guard of claim 9, wherein said cover is reversibly pivotably attached to said base member by said male hinge member that slideably inserts into a hinge slot on the upper planar surface of said base.

12. The collapsible food guard of claim 11, wherein the hinge slot has a circular cross-section.

13. The collapsible food guard of claim 7, wherein the cover is reversibly pivotably attached to said base by a live hinge.

14. A collapsible food guard for displaying and serving food comprising a stationary base member and a pivotable shield assembly; said stationary base member comprising a substantially planar upper surface having a linear hinge slot therein sized and shaped for slideably receiving a male hinge member, said pivotable shield assembly being semi-cylindrical in shape and having opposing closed ends, said pivotable shield assembly comprising a semi-cylindrical resilient transparent shield, a first opposing sidewall and a second opposing sidewall, said resilient transparent shield being substantially rectangular in shape having a frontal edge, a distal edge and two opposing lateral edges, said distal edge being attached to a male hinge member that is sized and shaped for slideably entering the linear hinge slot on said stationary base member to form a pivotable hinge, each of said opposing sidewalls having an arcuate upper surface for reversibly engaging a respective opposing lateral edge of said resilient transparent shield and having a planar lower surface for pivotably engaging the planar surface of said base member, said opposing lateral edges of said resilient transparent shield having substantially the same length as said arcuate upper surface such that when said resilient transparent shield is bent to engage and conform to said arcuate surface, the opposing side walls and shield forming a pivotable semi-cylindrical dome having planar base, said planar base forming a seal with said planar upper surface of said stationary base member when said pivotable shield assembly pivots downward, thereby displaying any item thereunder, said shield assembly providing access to any contents under the shield assembly when the shield assembly pivots upward.

15. The collapsible food guard of claim 14, wherein the resilient transparent shield is made from a plastic selected from the group consisting of polycarbonate, polyethylene terephthalate and polyvinyl chloride.

16. The collapsible food guard of claim 15, wherein the plastic is a polycarbonate.

17. The collapsible food guard of claim 14, wherein the stationary base member is wood, plastic, glass, stone, ceramic or a stone composite.

18. The collapsible food guard of claim 17, wherein the plastic is melamine.

* * * * *